US005774913A

United States Patent [19]

Allen et al.

[11] Patent Number: 5,774,913

[45] Date of Patent: Jul. 7, 1998

[54] BEDSPREAD HOLDING DEVICE

[76] Inventors: Judy A. Allen; Wayne Allen, both of 1061 Torrey Pines Rd., Chula Vista, Calif. 91915

[21] Appl. No.: 878,808

[22] Filed: Jun. 19, 1997

[51] Int. Cl.[6] ..... A47C 21/00

[52] U.S. Cl. ..... 5/504.1; 5/507.1

[58] Field of Search ..... 5/426, 504.1, 507.1

[56] References Cited

U.S. PATENT DOCUMENTS 2,562,333 9/1951 Ries ..... 5/504.1

5,001,795 3/1991 Kasten ..... 5/504.1

5,305,480 4/1994 Loren et al. ..... 5/504.1

5,652,979 8/1997 Pugh et al. ..... 5/504.1

*Primary Examiner*—Michael F. Trettel

[57] ABSTRACT

A bedspread holding device including an interior frame portion positioned laterally between a mattress and a box-spring of a bed. An exterior frame portion is coupled with respect to the interior frame portion and has an extended orientation adapted for supporting a bedspread thereon.

1 Claim, 2 Drawing Sheets

BEDSPREAD HOLDING DEVICE

BACKGROUND OF THE INVENTION

1. Field of the Invention

The present invention relates to a bedspread holding device and more particularly pertains to holding a folded bedspread at a foot of a bed with a bedspread holding device.

2. Description of the Prior Art

The use of mattress attachments is known in the prior art. More specifically, mattress attachments heretofore devised and utilized for the purpose of supporting bed linens are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,426,800 to St. John et al. discloses an apparatus for storing bedspread during sleeping hours. U.S. Pat. No. 5,305,480 to Loren et al. discloses a bed spread saver. U.S. Pat. No. Des. 273,643 to Sanker et al. discloses the ornamental design for a slidable bedclothes rack for insertion between a mattress and box springs. U.S. Pat. No. 3,961,385 to Ferry discloses a placement for bedspread. U.S. Pat. No. 5,001,795 to Kasten discloses a bedspread rack. U.S. Pat. No. 3,885,256 to Du Boff discloses a bedspread holder or the like.

While these devices fulfill their respective, particular objective and requirements, the aforementioned patents do not describe a bedspread holding device for holding a folded bedspread at a foot of a bed.

In this respect, the bedspread holding device according to the present invention substantially departs from the conventional concepts and designs of the prior art, and in doing so provides an apparatus primarily developed for the purpose of holding a folded bedspread at a foot of a bed.

Therefore, it can be appreciated that there exists a continuing need for new and improved bedspread holding device which can be used for holding a folded bedspread at a foot of a bed. In this regard, the present invention substantially fulfills this need.

SUMMARY OF THE INVENTION

In the view of the foregoing disadvantages inherent in the known types of mattress attachments now present in the prior art, the present invention provides an improved bedspread holding device. As such, the general purpose of the present invention, which will be described subsequently in greater detail, is to provide a new and improved bedspread holding device and method which has all the advantages of the prior art and none of the disadvantages.

To attain this, the present invention essentially comprises an interior frame portion positioned laterally between a mattress and a boxspring of a bed. The interior frame portion comprises a lateral support having a length less than a width of the mattress and the boxspring. The lateral support has four longitudinal supports extending rearward therefrom. Each of the four longitudinal supports is defined by a top wall, two downwardly extending side walls and an open outer end. Each of the longitudinal supports has a length essentially equal to the length of the lateral support. Two of the longitudinal supports extend from ends of the lateral support with the two remaining longitudinal supports extending from intermediate locations between the ends of the lateral support. An exterior frame portion is coupled with respect to the interior frame portion and has an extended orientation adapted for supporting a bedspread thereon. The exterior frame portion comprises a pair of base portions joined together at interior edges thereof in a linear orientation to form a foot portion. The base portions each have arcuate upper edges and planar lower edges. The foot portion has four longitudinal members extending forwardly therefrom. The four longitudinal members are slidably received within the open outer ends of the four longitudinal supports of the interior frame portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bedspread holding device which has all the advantages of the prior art mattress attachments and none of the disadvantages.

It is another object of the present invention to provide a new and improved bedspread holding device which may be easily and efficiently manufactured and marketed.

It is a further object of the present invention to provide a new and improved bedspread holding device which is of durable and reliable construction.

An even further object of the present invention is to provide a new and improved bedspread holding device which is susceptible of a low cost of manufacture with regard to both materials and labor, and which accordingly is then susceptible of low prices of sale to the consuming public, thereby making such a bedspread holding device economically available to the buying public.

Even still another object of the present invention is to provide a new and improved bedspread holding device for holding a folded bedspread at a foot of a bed.

Lastly, it is an object of the present invention to provide a new and improved bedspread holding device including an interior frame portion positioned laterally between a mattress and a boxspring of a bed. An exterior frame portion is coupled with respect to the interior frame portion and has an extended orientation adapted for supporting a bedspread thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
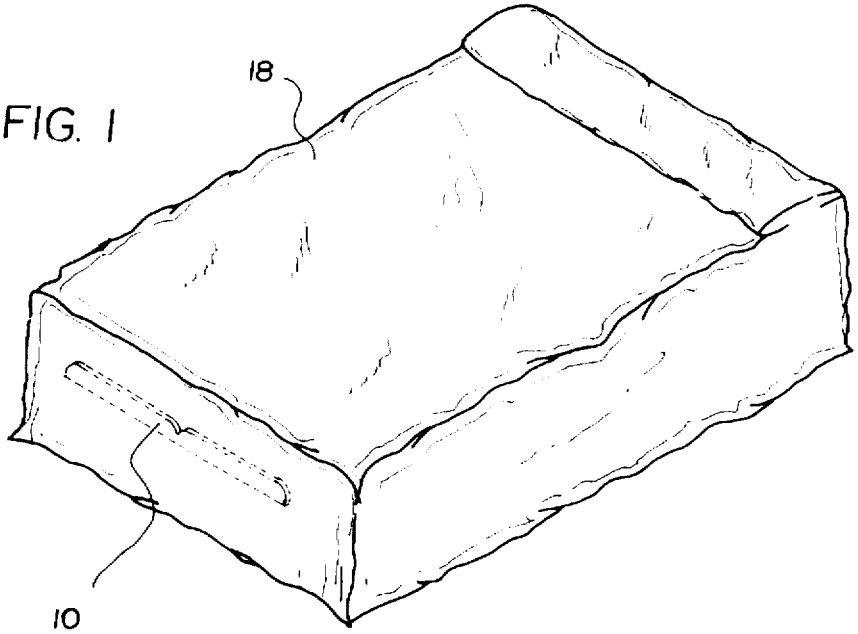
FIG. 1 is a perspective view of the preferred embodiment of the bedspread holding device in a closed orientation and constructed in accordance with the principles of the present invention.
Figure 2:
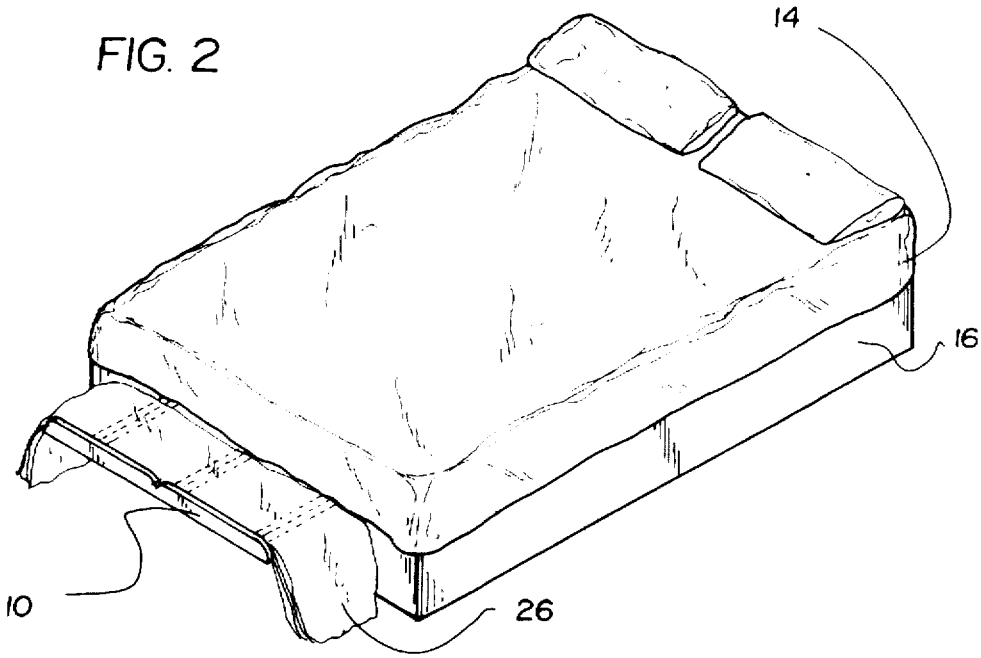
FIG. 2 is a perspective view of the present invention illustrated in use in an open orientation.
Figure 3:
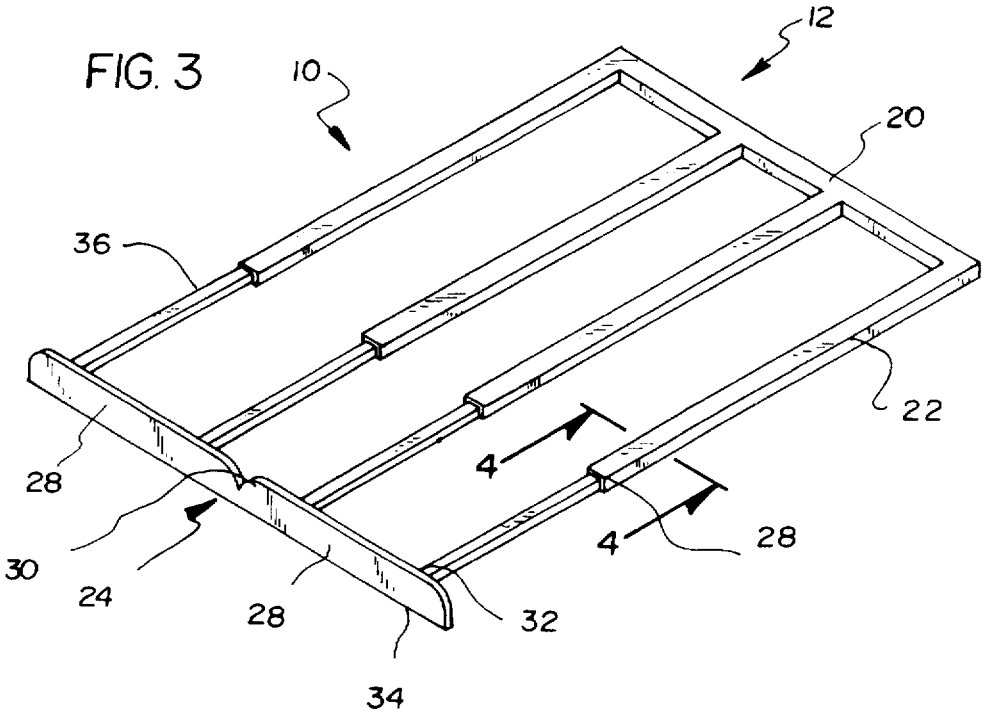
FIG. 3 is a plan perspective view of the present invention.
Figure 4:
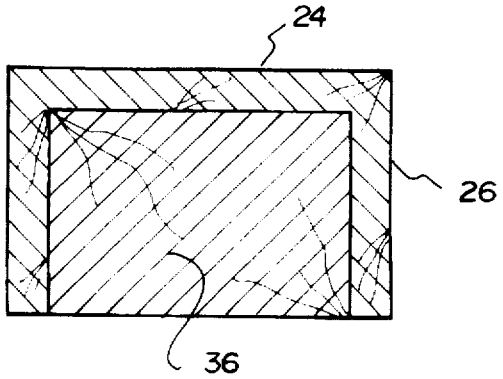
FIG. 4 is a cross-sectional view as taken along line 4—4 of FIG. 3.

With reference now to the drawings, and in particular, to FIGS. 1 through 4 thereof, the preferred embodiment of the new and improved bedspread holding device embodying the principles and concepts of the present invention and generally designated by the reference number 10 will be described.

Specifically, it will be noted in the various Figures that the device relates to a bedspread holding device for holding a folded bedspread at a foot of a bed. In its broadest context, the device consists of an interior frame portion and an exterior frame portion. Such components are individually configured and correlated with respect to each other so as to attain the desired objective.

The interior frame portion 12 is positioned laterally between a mattress 14 and a boxspring 16 of a bed 18. The interior frame portion 12 comprises a lateral support 20 having a length less than a width of the mattress 14 and the boxspring 16. The lateral support 20 has four longitudinal supports 22 extending rearward therefrom. Each of the four longitudinal supports 22 is defined by a top wall 24, two downwardly extending side walls 26 and an open outer end 28. Each of the longitudinal supports 22 has a length essentially equal to the length of the lateral support 20. Two of the longitudinal supports 22 extend from ends of the lateral support 20 with the two remaining longitudinal supports extending from intermediate locations between the ends of the lateral support 20.

The exterior frame portion 24 is coupled with respect to the interior frame portion 12 and has an extended orientation adapted for supporting a bedspread 26 thereon. The exterior frame portion 24 comprises a pair of base portions 28 joined together at interior edges thereof in a linear orientation to form a foot portion 30. The base portions 28 each have arcuate upper edges 32 and planar lower edges 34. The foot portion 30 has four longitudinal members 36 extending forwardly therefrom. The four longitudinal members 36 are slidably received within the open outer ends 28 of the four longitudinal supports 22 of the interior frame portion 12.

The present invention is an extending rail unit that holds a folded bedspread or comforter at the foot of the bed. The preferable construction is all wood, rail type construction, consisting of two pieces that slide one inside the other.

To use, simply place the present invention between the mattress and the boxspring of the bed. When the holder is extended from the foot of the bed, it acts as a shelf in which to store a bedspread or comforter. When not in use, the holder slides back into place and out of the way until it is needed again with the end of the bedspread or comforter covering the exposed portion of the present invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A bedspread holding device for holding a folded bedspread at a foot of a bed comprising, in combination:

an interior frame portion positioned laterally between a mattress and a boxspring of a bed, the interior frame portion comprising a lateral support having a length less than a width of the mattress and the boxspring, the lateral support having four longitudinal supports extending rearward therefrom, each of the four longitudinal supports being defined by a top wall, two downwardly extending side walls and an open outer end, each of the longitudinal supports having a length essentially equal to the length of the lateral support, two of the longitudinal supports extending from ends of the lateral support with two remaining longitudinal supports extending from intermediate locations between the ends of the lateral support; and an exterior frame portion coupled with respect to the interior frame portion and having an extended orientation adapted for supporting a bedspread thereon, the exterior frame portion comprising a pair of base portions joined together at interior edges thereof in a linear orientation to form a foot portion, the base portions each having arcuate upper edges and planar lower edges, the foot portion having four longitudinal members extending forwardly therefrom, the four longitudinal members slidably received within the open outer ends of the four longitudinal supports of the interior frame portion.

* * * * *